US012733717B2

(12) United States Patent
Mazzarolo et al.

(10) Patent No.: US 12,733,717 B2
(45) Date of Patent: Sep. 15, 2026

(54) SPORTS SHOE

(71) Applicant: ALPINESTARS RESEARCH S.P.A., Maser (IT)

(72) Inventors: Giovanni Mazzarolo, Coste di Maser (IT); Daniele Vanin, Quinto di Treviso (IT); Luca Gabriele Coniglio, Montebelluna (IT)

(73) Assignee: ALPINESTARS RESEARCH S.P.A., Maser (IT)

( * ) Notice: Subject to any disclaimer, the term of this patent is extended or adjusted under 35 U.S.C. 154(b) by 116 days.

(21) Appl. No.: 18/722,309

(22) PCT Filed: Dec. 20, 2022

(86) PCT No.: PCT/IB2022/062532
§ 371 (c)(1),
(2) Date: Jun. 20, 2024

(87) PCT Pub. No.: WO2023/119149
PCT Pub. Date: Jun. 29, 2023

(65) Prior Publication Data

US 2025/0134211 A1 May 1, 2025

(30) Foreign Application Priority Data

Dec. 22, 2021 (IT) ..... 102021000032117

(51) Int. Cl.
*A43C 11/16* (2006.01)

(52) U.S. Cl.
CPC ..... *A43C 11/165* (2013.01)

(58) Field of Classification Search
CPC ..... A43C 11/165
See application file for complete search history.

(56) References Cited

U.S. PATENT DOCUMENTS 5,934,599 A * 8/1999 Hammerslag ..... A43C 11/00 242/396.2
10,004,295 B2 * 6/2018 Gerber ..... A43B 23/028
(Continued)

FOREIGN PATENT DOCUMENTS

| | | |
|---|---|---|
| EP | 2359708 A1 | 8/2011 |
| EP | 3019043 B1 | 9/2019 |
| WO | 2010059989 A2 | 5/2010 |

OTHER PUBLICATIONS

International Search Report and Written Opinion of the International Application No. PCT/IB2022/062532, mailed Mar. 9, 2023, 10 pg.

*Primary Examiner* — David M Upchurch
(74) *Attorney, Agent, or Firm* — Fredrikson & Byron, P.A.

(57) ABSTRACT

A sports shoe including an opening defined by a first side and a second side, with the opening permitting a foot to be placed in or withdrawn from the sports shoe.
The sports shoe also includes a closure device including a lace and an actuating member wherein the lace extends between the first side and the second side to selectively adjust the size of said opening. The lace is operatively connected to the actuating member so that an incremental actuation of the actuating member causes the tightening or the loosening of the lace.
The sports shoe also includes a support device for the actuating member, with the support device being provided with a base to which the actuating member is coupled.
At least one protecting wall extends upwards from the base and encircles at least partially the actuating member.

20 Claims, 7 Drawing Sheets

(56) References Cited

U.S. PATENT DOCUMENTS

| | | | | |
|---|---|---|---|---|
| 10,258,109 | B2 * | 4/2019 | Midorikawa | A43B 23/02 |
| 2006/0196083 | A1 * | 9/2006 | Martin | A43B 7/20 36/50.5 |
| 2010/0139057 | A1 * | 6/2010 | Soderberg | B65H 75/4434 242/396.2 |
| 2013/0269219 | A1 | 10/2013 | Burns et al. | |
| 2013/0312293 | A1 | 11/2013 | Gerber | |
| 2017/0027287 | A1 * | 2/2017 | Burns | A43C 11/20 |
| 2017/0265561 | A1 | 9/2017 | Beers et al. | |
| 2017/0303643 | A1 * | 10/2017 | Converse | A43C 11/00 |
| 2020/0345107 | A1 * | 11/2020 | Burt | A43C 17/02 |
| 2020/0346888 | A1 * | 11/2020 | Kruse | A43B 23/0205 |

* cited by examiner

SPORTS SHOE

Related Applications

This application is a 35 U.S.C. 371 national stage filing from International Application No. PCT/IB2022/062532, filed Dec. 20, 2022, which claims priority to Italian Patent Application No. 102021000032117, filed Dec. 22, 2021. Then entire contents of these applications are incorporated herein by reference in their entireties.

FIELD OF THE INVENTION

The present invention relates to a sports shoe. In particular, the present invention relates, albeit not exclusively, to a sports shoe suitable for use in motorcycling or cycling activities.

BACKGROUND

Sports shoes provided with a closure device comprising a lace extending between the sides of an opening of the shoe and operatively connected to an actuating member, like for example a rotatable knob, are well known in the art.

An example of a closure device of this type is disclosed in WO2010/059989 or in EP2359708.

Such a closure device is greatly appreciated since it permits in an easy manner to secure the shoe to the foot of the user. As a matter of fact, by acting on the rotatable knob the user is able to tighten or loose the lace so as to draw together or move apart the sides defining the opening of the shoe.

However, to be easily accessible for the user, the rotatable knob is generally applied on an outer surface of the shoe so as to project therefrom. Usually the rotatable knob is applied close to the user's ankle or heel. Consequently, during the use of the shoe, the rotatable knob is exposed to impact against objects with the risk that such impacts can result in an accidental opening of the closure device.

Moreover, in case of an accident causing the sliding of the user along the ground, the knob can be pressed against the foot of the user, bruising or even injuring the user.

Similar problems arise in case the actuating member of the closure device is not a rotatable element. For example, even in case a swinging arm is used to pull or tighten the laces of the shoe, accidental opening can be encountered during the use of the sports shoe. Similarly, such types of closures might also affect the comfort of the user and can cause bruising or injuries in case of a direct impact against the ground.

BRIEF SUMMARIES OF OBJECTS OF THE INVENTION

The object of the present invention is to provide a sports shoe comprising a closure device operable by means of an actuating member and suitable for solving at least partly the above mentioned problems and drawbacks.

In particular, an aim of the present invention is to provide a sports shoe comprising a closure device operable by means of an actuating member and suitable for avoiding accidental operation thereof.

A further aim of the present invention is to provide a sports shoe comprising a closure device operable by means of an actuating member and suitable for offering an improved protection to the user's foot, without affecting the comfort offered to the user and/or the operation of the closure device.

These and other objects and aims are achieved by a sports shoe according to claim 1.

BRIEF DESCRIPTIONS OF THE DRAWINGS

The advantages and the characteristic features of the invention will appear more clearly from the following description of preferred, but not exclusive, embodiments of the sports shoe with reference to the accompanying figures in which.

Figure 11:
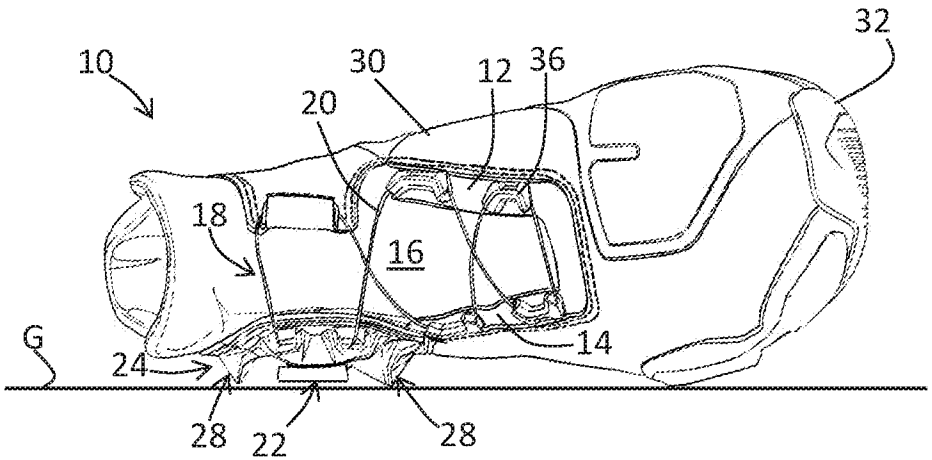
Figure 10:
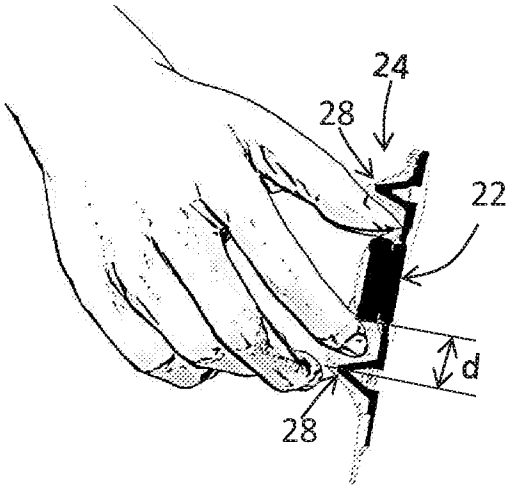
Figure 12:
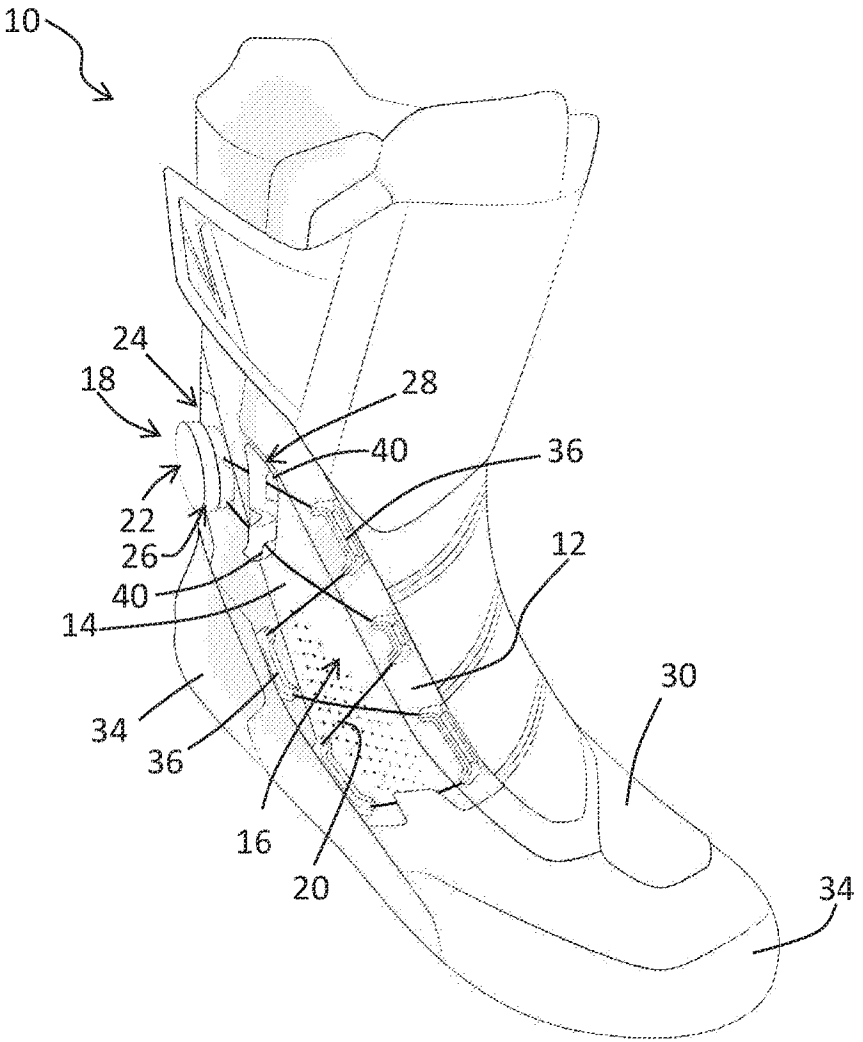

FIG. 10 schematically shows how the actuating device of the closure device of the sports shoe according to the invention can be operated;

FIG. 11 schematically shows an impact of the sports shoe of the invention against the ground;

FIG. 12 shows a perspective view of a further embodiment of the sports shoe according to the present invention.

DETAILED DESCRIPTION OF EMBODIMENTS OF THE INVENTION

With reference to the accompanying figures, a sports shoe according to the invention is indicated in its entirety by the reference 10.

Figure 2:
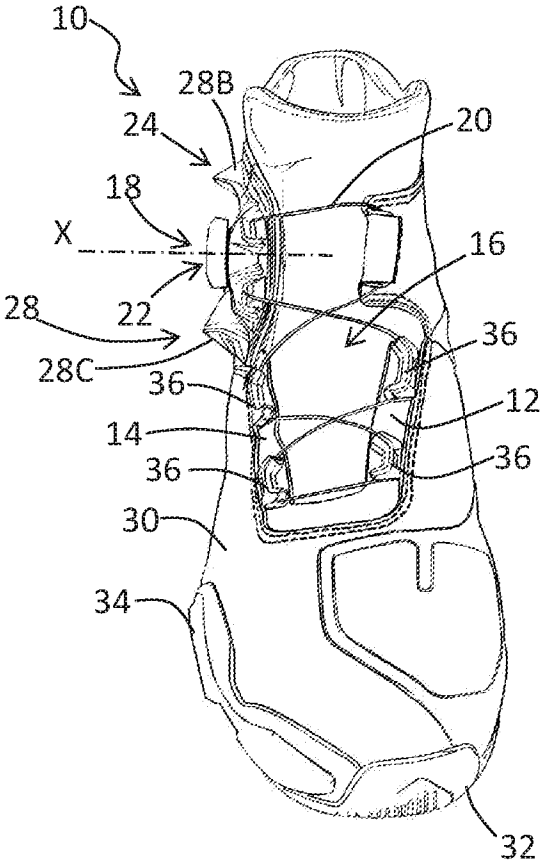
FIG. 2 is a front view of the sports shoe of FIG. 1.
Figure 1:
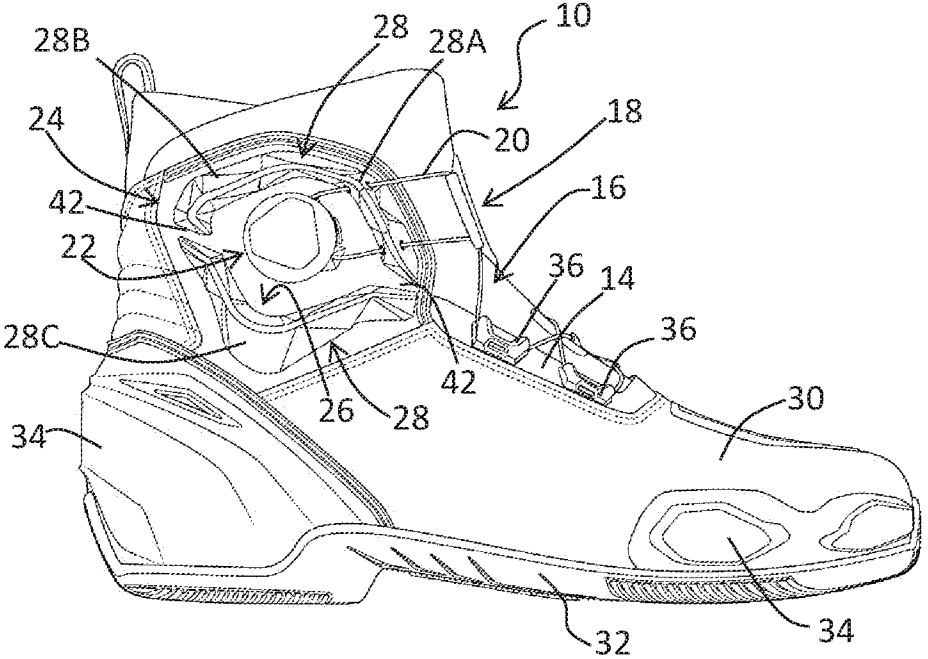
FIG. 1 shows a side view of a first embodiment of the sports shoe according to the present invention.

The sports shoe 10 comprises an opening 16 defined by a first side 12 and a second side 14. Preferably, as schematically shown in FIGS. 1 and 2, the opening 16 is a front opening defined by two parallel sides 12, 14.

Alternatively, as shown in FIG. 12, the opening 16 is a side opening. Said side opening is preferably defined by a first side 12 and a second side 14 at least partially overlapped to each other.

The opening 16 permits a foot to be placed in or withdrawn from the sports shoe 10.

The sports shoe 10 also comprises a closure device 18 comprising a lace 20 and an actuating member 22. The lace 20 extends between the first side 12 and the second side 14 of the sports shoe 10. The lace 20 fulfills the function of selectively adjusting the size of the opening 16.

Figure 3:
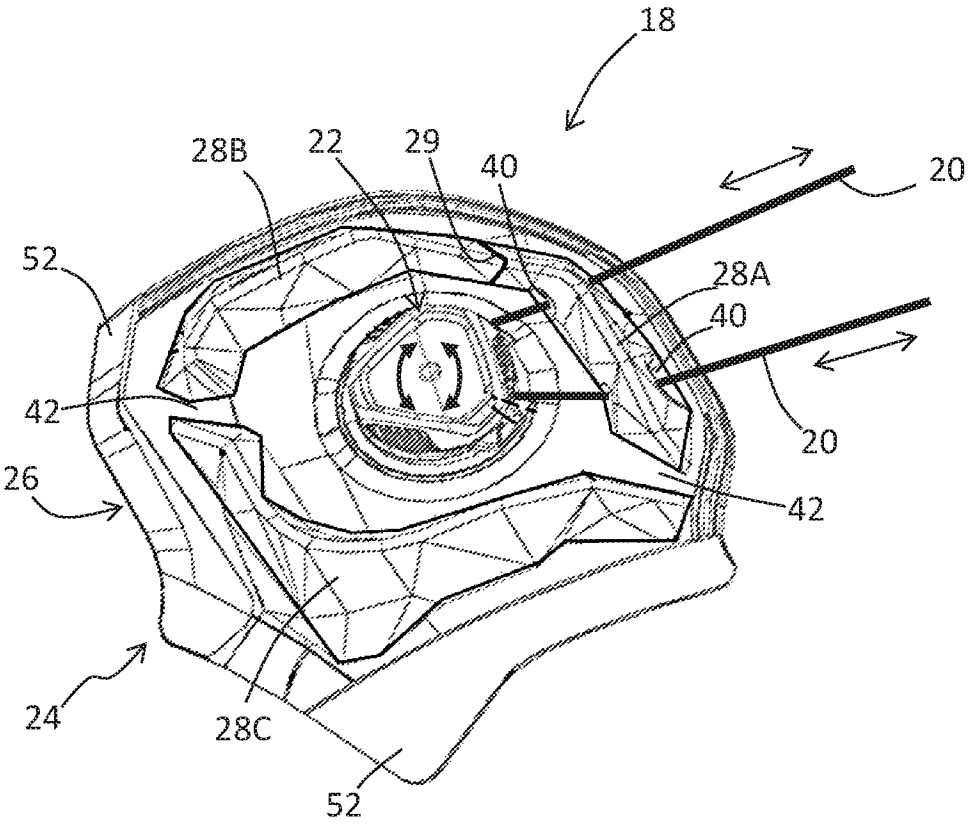
FIG. 3 is a perspective enlarged view of a component of the sports shoe of FIGS. 1 and 2.
Figure 3A:
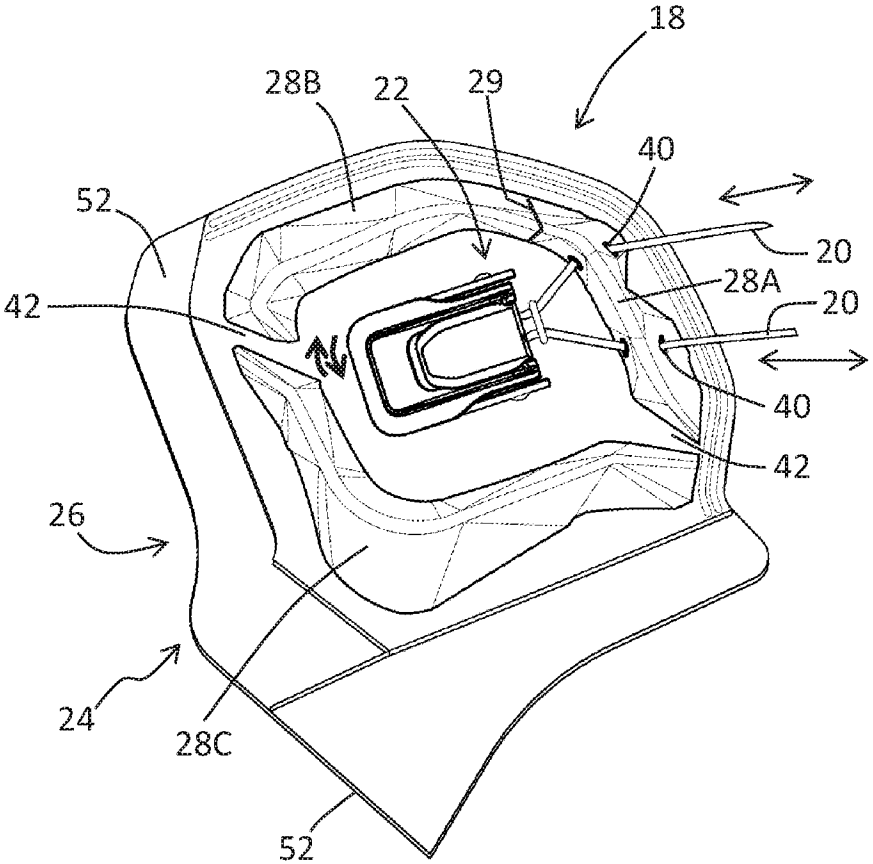
FIG. 3A is a view similar to FIG. 3, but relating to a different embodiment.

As shown in detail in FIGS. 3 and 3A, the lace 20 is operatively connected to the actuating member 22 so that an incremental actuation of the actuating member 22 causes the tightening or the loosening of the lace 20.

Preferably, the actuating member 22 is a rotatable knob. However, the sports shoe 10 of the present invention can be provided with different actuating members in order to meet other specific needs. For example, the actuating member 22 can be a swinging arm or a rotating lever or else any manual control causing the tightening or the loosening of the lace 20.

Alternatively, as schematically shown in FIG. 3A, the actuating member 22 can be a lever 22 designed to engage in a corresponding tooth of a toothed rack, not visible in FIG. 3A, applied on the sports shoe.

In case the actuating member is a rotatable knob, advantageously an incremental rotation of the rotatable knob 22 in a first direction causes the tightening of the lace 20, thereby drawing together the first side 12 and the second side 14 of the sports shoe 10, and an incremental rotation of the rotatable knob 22 in a second or opposite direction causes the loosening of the lace 20, thereby allowing the first side 12 and the second side 14 of the sports shoe 10 to be moved apart.

In case the actuating member is a lever, advantageously it is possible to adjust the opening of the shoe by engaging the lever in different teeth of the toothed plate disposed one after the other as done, for example, in a ski boot closure.

The sports shoe 10 further comprises a support device 24 for the actuating member 22. Said support device 24 is provided with a base 26 to which the actuating member 22 is coupled.

According to the invention, at least one protecting wall 28 extends upwards from the base 26 and encircles at least partially the actuating member 22.

In the meaning of the present invention "to encircle at least partially" means that the at least one protecting wall 28 encircles, at least for a limited extent, the actuating member 22.

As it will appear clearly from the following description, the provision of the protecting wall 28 permits to protect the actuating member 22 against impacts with external objects to avoid that such impacts can cause an accidental operation of the actuating member 22.

Moreover, the provision of the protecting wall 28 permits to also protect the user's foot in case of an impact.

Furthermore, the provision of the protecting wall 28 does not affect the functioning of the closure device 18 and does not hinder the handling of the actuating member 22 during the tightening or the loosening of the lace 20.

Lastly, the provision of the protecting wall 28 permits the actuating member 22 to remain tied to the shoe, even if the closure device 18 is not tighten, for example after having received a hit.

The various components of the sports shoe 10 and the support device 24 will be disclosed in detail in the following.

Preferably, the sports shoe 10 is a protective shoe which can be advantageously used in all the fields where an effective protection to the user's foot must be obtained. For example, the sports shoe 10 can be advantageously used by motorcyclists.

As shown in FIGS. 1-2, the sports shoe 10 can be a protective shoe configured to cover the foot and the ankle of the user. Alternatively, the sports shoe 10 can be a protective boot suitable for covering, in addition to the foot and the ankle of the user, the lower portion of the leg (see for example FIG. 12).

The sport shoe 10 preferably comprises an upper 30 to which an outsole 32 is fixed. The upper 30 can be made of leather or leather-like material. Alternatively, the upper 30 can be made of textile material.

The upper 30 can be provided with protective inserts 34, for example made of polymeric material, applied in portions of the upper 30 more prone to abrasion, like the heel portion and/or the toe portion.

The protective inserts 34 can be formed by a coating layer applied on the outer surface of the upper 30.

The sports shoe 10 can also be provided with toe cap and/or ankle protections (not shown in the enclosed figures) so as to make the shoe 10 suitable for being used as a safety shoe.

The outsole 32 in turn is preferably made of rubber or polymeric material.

The outsole 32 generally is glued to the bottom portion of the upper 30. Alternatively, the outsole 32 can be directly over-injected over the upper 30.

As aforementioned, the sports shoe 10 comprises an opening 16 which is defined by the first side 12 and the second side 14.

Preferably, as shown in FIGS. 1-2, a plurality of lace guides 36 can be arranged at the first side 12 and at the second side 14 of the opening 16. Preferably, the lace guides 36 are applied at the edge portion of the first and second sides 12, 14. The lace 20 is designed to slidably pass through such lace guides 36 which have the function to guide the lace 20 during the tightening and/or loosening movements.

Any suitable number of lace guides 36 can be used in the sports shoe 10.

The lace 20 is preferably designed to extend through the full set of lace guides 36.

The lace 20 can be made of textile material. Alternatively, the lace 20 can be made of flexible material having enough strength such as plastic material or a metal like material. Advantageously, the lace 20 can consist of stainless steel wire enwrapped in a sheath made of polymeric material.

The lace 20 is operated by means of the actuating member 22 which permits to tighten or loose the lace 20 depending on the actuating direction of the actuating member 22. For example, in case the actuating member 22 is a rotatable knob 22 of the type shown in FIG. 3, by rotating the rotatable knob 22 in a clockwise direction it will be possible to tighten the lace 20 so as to close the opening 16. Alternatively, by rotating the rotatable knob 22 in an anticlockwise direction it will be possible to loose the lace 20 so as to make possible to space apart the sides 12, 14 defining the opening.

The closure device 18 comprising the lace 20 and the actuating member 22 is well known in the art and it does not need to be disclosed in further detail.

For example a closure device suitable for being used with the sport shoe 10 of the present invention is disclosed in WO2010/059989 or in EP3019043.

As it is shown in the enclosed figures, the actuating member 22 is applied at the ankle portion of the sports shoe. However, a different positioning of the actuating member 22 is possible. For example, the actuating member 22 can be positioned at a heel portion, at the front portion or at a lateral portion of the sport shoe 10.

As shown in FIG. 2, the transversal axis X of the actuating member 22 is substantially perpendicular to the outer surface of the upper 30 of the sport shoes 10.

Figure 5A:
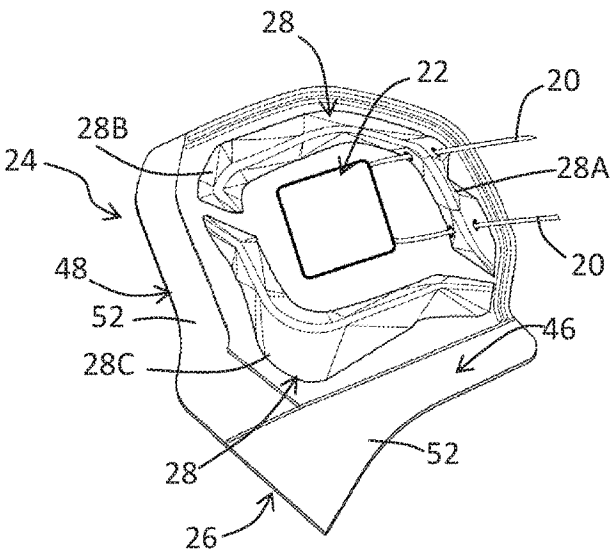
FIGS. 5 and 5A are views similar to FIG. 3, but relating to different embodiments of the component of FIG. 3.
Figure 5:
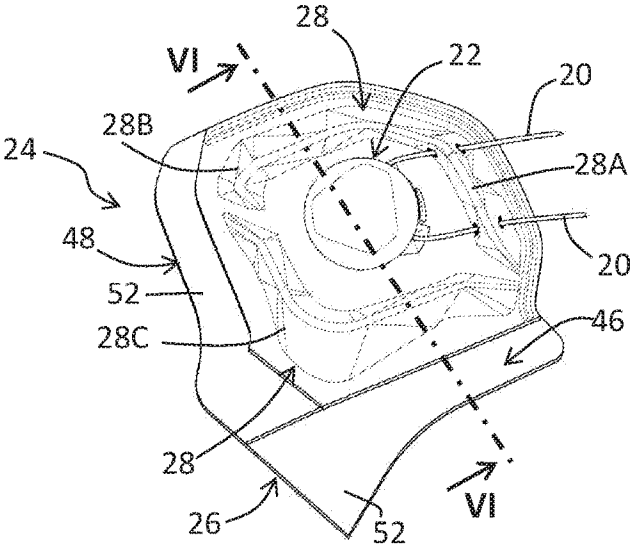

The actuating member 22 as shown in FIGS. 5 and 5A can have different shapes.

In case the actuating member is a rotatable knob 22, the latter can have a rounded shape. Alternatively, as shown for example in FIG. 3, the rotatable knob 22 can have a substantially triangular shape.

The actuating member 22 preferably comprises two radial slots for the entry and the exit of the lace 20.

As aforementioned, the sports shoe 10 according to the invention also comprises a support device 24 for the actuating member 22.

The support device 24 comprises a base 26 which is preferably provided with a fastening edge 52, by means of which the support device 24 can be fastened to the outer surface of the upper 30.

Preferably, the base 26 has a planar shape.

As shown in the enclosed figures, the at least one protecting wall 28 is preferably arranged on a peripheral portion of the base 26.

The protecting wall 28 can have a closed shape, so as to fully encircle the actuating member 22. Alternatively, the protecting wall 28 can be split in more than one portion 28A, 28B, 28C which can be separated by division cuts 42. Said cuts 42 are preferably of reduced dimensions so as not to affect the protection offered by the wall 28 to the actuating member 22 (see for example FIGS. 3 and 3A).

At the same time, the provision of the division cuts 42 makes more flexible the support device 24 which can be better adjusted to the portion of the upper 30 to which is affixed.

As shown in the enclosed figures, the actuating member 22 is designed to be fixed at the base 26 of the support device 24 so as to be encircled by the protecting wall 28.

Figure 4:
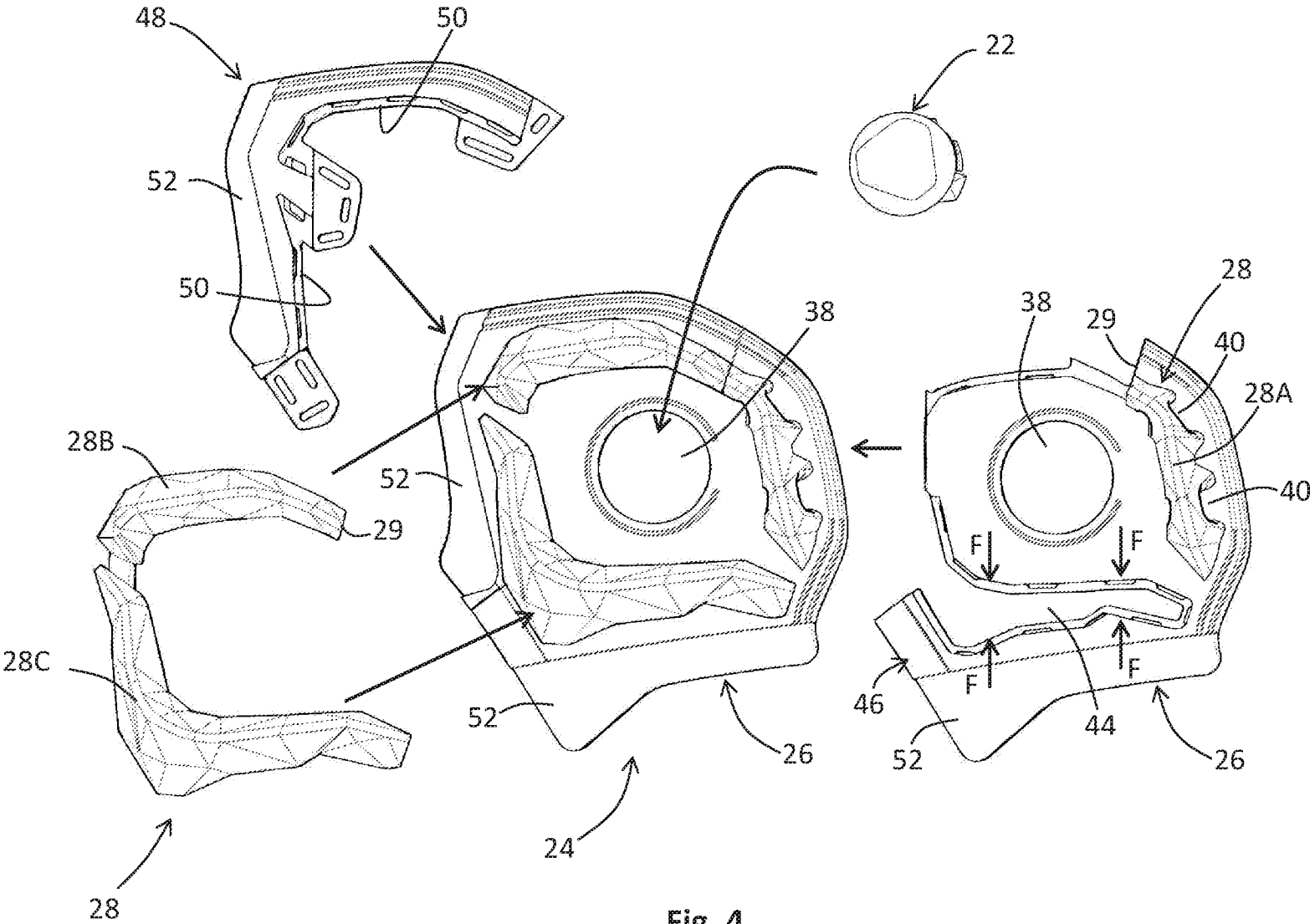
FIG. 4 is an exploded enlarged view of a further embodiment of the component of FIG. 3.

As schematically shown in FIG. 4, the actuating member 22 can be fixed at a seat 38 provided in a central portion of the base 26. The seat 38 can be a fixing hole.

Advantageously, the actuating member 22 can be fastened to the base 26 by means of seam. In this way it is assured that, during the use of the sports shoe 10, the actuating member 22 stays inside its support device 24 in a proper position.

Figure 6:
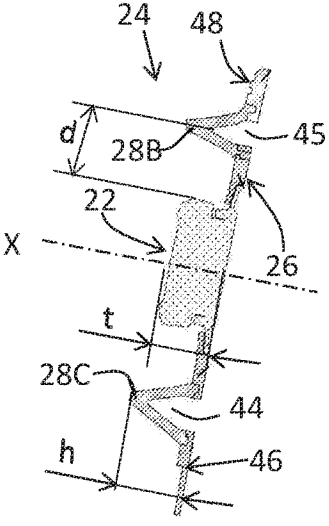
FIG. 6 is a schematic cross-section view taken along the line VI-VI of FIG. 5.

Advantageously, as schematically shown in FIG. 6, the perimetral surface of the actuating member 22 is spaced apart by a distance d from the facing portion of the protecting wall 28. The distance d is preferably greater than 5 mm.

In this way, the handling of the actuating member 22 is not hindered by the presence of the protecting wall 28. As a matter of fact, a free space for the fingers of the user is arranged inside the support device 24 around the actuating member 22 (see FIG. 10). Preferably, the protecting wall 28 projects outwardly from the base 26 to a height h which is greater than the thickness t of the actuating member 22, the thickness t being measured along the direction of the transversal axis X (see FIG. 6).

In this way, the protecting wall 28 is suitable for protecting the actuating member 22 in case of an impact of the shoe against an obstacle or the ground G, avoiding that the actuating member 22 can be inadvertently operated (see for example FIG. 11).

Preferably, the protecting wall 28 is provided with at least one tunnel-like seat 40 for the lace 20 (see FIGS. 3 and 3A). Preferably, the protecting wall 28 is provided with two tunnel-like seats 40. The tunnel-like seats 40 permit to connect the lace 20 to the actuating member 22 when the latter is fastened to the base 26 of the support device 24.

The seats 40 are sized and shaped so as not to affect the movements of the lace 20 when the actuating member 22 is operated by the user so as to also act as guide laces. At the same time, in case of an impact the seats 40 are able to protect the lace 20 from being affected or damaged by external bodies.

Preferably, the base 26 and the protection wall 28 are integral to each other.

As shown in FIG. 4, the base 26 is preferably provided with at least one perimetral aperture 44. The aperture 44 permits to lighten the base 26 and at the same time it allows the base to better adapt to the movement of the user's foot.

As schematically shown in FIG. 4, the base 26 thanks to the provision of the aperture 44 is able to at least partially absorb any transversal force. Such a force is schematically shown in FIG. 4 by means of the arrows F.

As shown in FIG. 4, the aperture 44 can define a cantilever portion 46 in the base 26. Said cantilever portion 46 when the base 26 undergoes a transversal force F can implement a spring effect assuring a better comfort to the user. As shown in the enclosed figures, at least a portion of the fastening margin 52 can be provided at the cantilever portion 46.

Preferably, at least a portion of the protecting wall 28 has a hollow profile (see FIGS. 6-10). Advantageously, the protecting wall 28 having a hollow profile can be arranged at the aperture 44 provided in the base 26.

In this way, during the normal use of the sports shoe or in case of an impact, the protecting wall 28 can undergo a deformation all along its extension to follow natural movements of the user's foot. The comfort of the shoe is enhanced and at the same time the deformation of the protecting wall does not affect the positioning of the actuating member 22 inside the support device 24 since the seat 38 is not influenced by the movements of the wall 28.

The support device 24 can be made of polymeric material.

In a first embodiment, the base 26 and the protecting wall 28 are made of the same polymeric material.

Alternatively, the base 26 can be made of a first polymeric material and the protecting wall 28 can be made of a second different polymeric material.

Preferably, the first polymeric material has hardness greater than the second polymeric material. In a preferred embodiment, the base can be made of a reinforced polyamide resin, for example toughened PA66, while the protecting wall 28 can be made of thermoplastic polyurethane material.

In a preferred embodiment, at least the portion 28A of the protecting wall 28, wherein the tunnel-like seats 40 are provided, is integral with the base 26 and it is made of the same material of the base 26 (see for example FIGS. 4 and 5). In this way it is assured that no deformation may occur in the tunnels 40 during the use of the shoe.

Advantageously, the support device 24 can be manufactured by means of injection moulding by over-injecting the protecting wall 28 over the base 26.

In a further embodiment, as shown in FIG. 4, the base 26 can be provided with a perimetral insert 48, preferably of planar shape. The insert 48 is configured to be joined to the base 26 in abutting relationship such that the top surface of the insert 48 substantially lies on the same plane of the base 26.

Preferably, the insert 48 is provided with at least one recess 50 configured to define a further aperture 45 when the insert is joined to the base 26. Such an aperture is clearly visible in FIGS. 6-9.

Preferably, the insert 48 is made of polymeric material. Advantageously, the insert 48 is made of thermoplastic polyurethane.

In the preferred embodiment, the insert 48 is made of thermoplastic polyurethane having hardness less than the base 26 and the protecting wall 28.

Advantageously, the insert 48 can be joined to the base 26 by means of the protecting wall 28 which acts as a connecting element.

Preferably, at least a portion 28B, 28C of the protecting wall 28 can be over injected over the insert 48 and over the base 26. In this case, the portion 28 of the protecting wall 28 over injected on top of the insert 48 and on top of the base 26 acts substantially as a connecting hinge.

As schematically shown in the embodiment of the support device 24 of FIG. 4, the base 26 and the portion 28A of the protecting wall 28, wherein the tunnels 40 for the lace 20 are provided, can be made of a rigid material, like polyamide. In such an embodiment the perimetral insert 48 and the remaining portion 28B, 28C of the protecting wall 28 can be made of thermoplastic polyurethane. Preferably, the thermoplastic polyurethane of the insert 48 has hardness less than that of the protecting wall 28B, 28C.

In this embodiment, the support device 24 in its entirety can be considered as formed by three components integral to each other and having three different values of hardness.

Preferably, in this embodiment the portion 28A of the protecting wall 28 is directly joined to the portion 28B provided on the perimetral insert 48 along the joining line 29 (see FIGS. 3, 3A and 4).

This arrangement permits to obtain a support device 24 able to undergo controlled deformations in order to better adapt to movements of the user's foot.

In FIG. 12, a further embodiment of the sports shoe 10 of the present invention is shown.

In this embodiment, the protecting wall 28 encircles for a limited extent the actuating member 22. In particular, the protecting wall 28 is positioned at the front of the actuating member 22.

The protecting wall 28 is preferably provided with at least one tunnel-like seat 40 for the lace 20.

Even if the protecting wall 28 encircles only a limited portion of the actuating member 22, the embodiment of FIG. 12 is in any case effective in avoiding that the actuating member 22 can be detached, after having received a hit, from the support device 24.

As a matter of fact, in case the actuating member 22 is detached from the support device 24, the provision of the protecting wall with the tunnel-like seats 40 permits the actuating member 22 not to come out from the support device 24, so as to remain tied to the foot of the user.

In the motorcycling sector this is particularly useful since it avoids the completed opening of the shoe, maintaining protection of the user's foot.

To further explain how the support device 24 works, reference will be made to FIGS. 6-9 which refers to the embodiment of FIG. 5. However similar notes are also valid for the other embodiments previously disclosed.

In FIG. 6, a cross section of the support device 24 is shown wherein the sports shoe 10 is in a rest condition. In this case, the hollow profile of the protecting wall 28 is not deformed and the perimetral insert 48 is still planar with the base 26.

Figure 7:
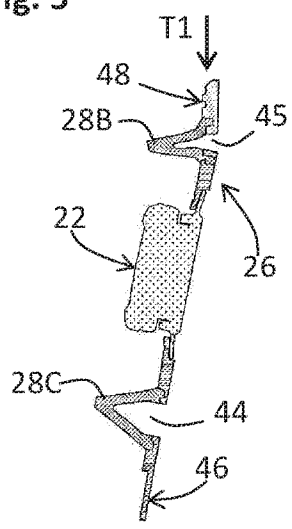

In FIG. 7, it is schematically shown how the support device 24 deforms during a phase, the stance phase, of the normal walking movement of the user. In this phase the top portion of the sports shoe 10 undergoes a compression, which is schematically represented by the arrow T1.

Such a compression causes a deformation of the portion of the protecting wall 28B positioned farther from the ground. Such a deformation, which is favored by the hollow profile of the wall 28B, permits the support device 24 to adapt to the user's foot movement and at the same time it does not affect the positioning of the actuating member 22 inside the support device 24 and consequently the tensioning of the lace 20.

Figure 8:
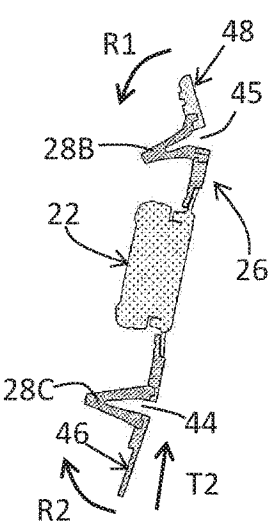

In FIG. 8 in turn it is schematically shown a possible eversion movement of the foot, namely an inward movement of the foot at the ankle joint, which can happen in a different phase of the walking movement.

As shown in FIG. 8, in this case not only the portion of the protecting wall 28B farther from the ground collapses, but also the portion 28C closer to the ground can be compressed (such a compression is schematically represented by the arrow T2). At the same time, a limited anti-clockwise rotation of the perimetral insert 48 with respect to the base 26 can be noticed. Such a rotation R1 is favored by the fact that the insert 48 is made of a softer material than the base 26 and by the way in which the insert 48 is joined to the base 26, namely by means of the over injected wall 28B arranged over the aperture 45.

Similarly a limited clockwise rotation of the projecting portion 46 with respect to the remaining portion of the base 26 can be noticed (see arrow R2). Also this rotation is favored by the hollow profile of the protecting wall 28C and by the aperture 44.

Figure 9:
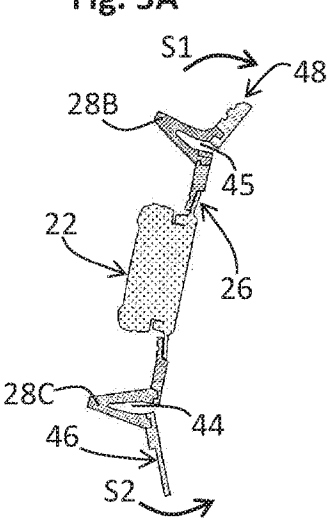
FIGS. 7-9 are views similar to FIG. 6, but relating to different operating conditions of the sports shoe.

Lastly, in FIG. 9 it is schematically shown a possible adduction movement of the foot, namely an outward movement of the foot at the ankle joint, which can happen during the walking movement.

Also in this case, both protecting walls 28B, 28C are compressed, while the perimetral insert 48 and the projecting portion 46 can undergo limited clockwise and anticlockwise rotations respectively (see arrows S1 and S2).

It is thus clear how the predefined objects may be achieved with the sports shoe 10 according to the invention.

As a matter of fact, the provision of the support device 24 permits to protect the actuating member 22 against impacts which can cause improper operations of the closure device 18.

At the same time the support device 24 does not hinder the operation of the actuating member 22 and does not affect the comfort of the sports shoe.

In particular, in case the actuating member 22 is applied at the ankle joint of the foot, the support device 24 is able to protect the actuating member 22 without hindering the movements of the user's foot.

The provision of the apertures 44, 45 provided in the base 26 and the fact that the protecting wall 28 has preferably a hollow profile assures that the support device 24 provides an enhanced protection to the user's foot being able to better follow the anatomy thereof.

Such a protection is also increased by the fact that the various components of the support device 24 can be manufactured with polymeric materials having different hardness.

Regarding the embodiments of the sports shoe 10 described above, the person skilled in the art may, to satisfy specific requirements, make modifications to and/or replace elements described with equivalent elements, without thereby departing from the scope of the accompanying claims.

The invention claimed is:

1. A sports shoe comprising:

an opening defined by a first side and a second side, the opening permitting a foot to be placed in or withdrawn from the sports shoe;

a closure device comprising a lace and an actuating member wherein the lace extends between the first side and the second side of the sports shoe to selectively adjust the size of said opening, the lace being operatively connected to the actuating member so that an incremental actuation of the actuating member causes the tightening or the loosening of the lace; and a support device for the actuating member, the support device being provided with a base to which the actuating member is coupled;

wherein at least one protecting wall extends upwards from the base and encircles at least partially the actuating member; and wherein the support device is made of polymeric material, the base being made of a first polymeric material and the at least one protecting wall being made of a second polymeric material wherein the first polymeric material has hardness greater than the second polymeric material.

2. The sports shoe according to claim 1, characterized in that said at least one protecting wall is arranged on a peripheral portion of the base, the actuating member being fixed at a seat provided in a central portion of the base.

3. The sports shoe according to claim 1, characterized in that said at least one protecting wall projects outwardly from the base to a height which is greater than a thickness of the actuating member.

4. The sports shoe according to claim 1, characterized in that a perimetral surface of the actuating member is spaced apart by a distance from a facing portion of the at least one protecting wall.

5. The sports shoe according to claim 1, characterized in that said at least one protecting wall is provided with at least one tunnel-like seat for the lace.

6. The sports shoe according to claim 1, characterized in that the base and the at least one protection wall are integral to each other.

7. The sports shoe according to claim 1, characterized in that the at least one protecting wall is split in more than one portion which are separated by division cuts.

8. The sports shoe according to claim 1, characterized in that the base is provided with a perimetral aperture, said perimetral aperture defining a cantilever portion in the base suitable for implementing a spring effect when the base undergoes a transversal force.

9. The sports shoe according to claim 1, characterized in that at least one portion of said at least one protecting wall has a hollow profile.

10. The sports shoe according to claim 1, characterized in that the base is provided with a planar perimetral insert configured to be joined to the base in abutting relationship such that the top surface of the insert substantially lies on the same plane of the base.

11. The sports shoe according to claim 10, characterized in that the planar perimetral insert is provided with at least one recess configured to define an aperture when the planar perimetral insert is joined to the base.

12. The sports shoe according to claim 10, characterized in that the planar perimetral insert is joined to the base by means of the at least one protecting wall.

13. The sports shoe according to claim 1, characterized in that the actuating member is a rotatable knob, an incremental rotation of the rotatable knob causing the tightening or the loosening of the lace.

14. The sports shoe according to claim 1, characterized in that:

the base is provided with a perimetral aperture, said perimetral aperture defining a cantilever portion in the base suitable for implementing a spring effect when the base undergoes a transversal force; and at least one portion of said at least one protecting wall has a hollow profile.

15. The sports shoe according to claim 14, characterized in that said at least one portion of the at least one protecting wall having a hollow profile is arranged at the perimetral aperture of the base.

16. The sports shoe according to claim 1, characterized in that:

said at least one protecting wall is provided with at least one tunnel-like seat for the lace.

17. The sports shoe according to claim 16, characterized in that the portion of the at least one protecting wall provided with the at least one tunnel-like seat is integral with the base, said portion being made of the same material of the base.

18. The sports shoe according to claim 1, characterized in that the base has a planar shape.

19. A sports shoe comprising:

an opening defined by a first side and a second side, the opening permitting a foot to be placed in or withdrawn from the sports shoe;

a closure device comprising a lace and an actuating member wherein the lace extends between the first side and the second side of the sports shoe to selectively adjust the size of said opening, the lace being operatively connected to the actuating member so that an incremental actuation of the actuating member causes the tightening or the loosening of the lace; and a support device for the actuating member, the support device being provided with a base to which the actuating member is coupled;

wherein at least one protecting wall extends upwards from the base and encircles at least partially the actuating member;

wherein the base is provided with a planar perimetral insert configured to be joined to the base in abutting relationship such that the top surface of the insert substantially lies on the same plane of the base;

wherein the planar perimetral insert is joined to the base by means of the at least one protecting wall; and wherein a portion of the at least one protecting wall joining the planar perimetral insert to the base and the planar perimetral insert is made of thermoplastic polyurethane, the thermoplastic polyurethane of the planar perimetral insert having hardness less than that of said portion of the protecting wall.

20. The sports shoe according to claim 19, characterized in that the base has a planar shape.

* * * * *